US007735164B1

(12) United States Patent
Patrick

(10) Patent No.: US 7,735,164 B1
(45) Date of Patent: Jun. 15, 2010

(54) DISPOSABLE PATIENT TRANSFER MATTRESS

(75) Inventor: James E. Patrick, Plainfield, IL (US)

(73) Assignee: Smart Medical Technology, Inc., Darien, IL (US)

( * ) Notice: Subject to any disclaimer, the term of this patent is extended or adjusted under 35 U.S.C. 154(b) by 311 days.

(21) Appl. No.: 11/999,738

(22) Filed: Dec. 5, 2007

Related U.S. Application Data

(63) Continuation-in-part of application No. 11/538,211, filed on Oct. 3, 2006, which is a continuation-in-part of application No. 11/036,413, filed on Jan. 14, 2005, now Pat. No. 7,114,204.

(51) Int. Cl.
*A61G 7/14* (2006.01)
*A47C 27/10* (2006.01)

(52) U.S. Cl. ..... 5/81.1 HS; 5/710; 5/713; 5/715

(58) Field of Classification Search ..... 5/706, 5/710, 713–715, 739, 81.1 HS, 86.1, 932; 285/103, 325
See application file for complete search history.

(56) References Cited

U.S. PATENT DOCUMENTS

| | | | | |
|---|---|---|---|---|
| 1,970,502 A | | 8/1934 | Hamza | |
| 2,265,268 A | * | 12/1941 | Culligan | 285/325 |
| 3,667,073 A | * | 6/1972 | Renfroe | 5/81.1 R |
| 3,705,429 A | | 12/1972 | Nail | |
| 3,739,407 A | | 6/1973 | Stiller et al. | |
| 3,760,899 A | | 9/1973 | Crossman et al. | |
| 3,948,344 A | | 4/1976 | Johnson et al. | |
| 3,959,835 A | | 6/1976 | Nos | |
| 4,272,856 A | | 6/1981 | Wegener et al. | |
| 4,528,704 A | | 7/1985 | Wegener et al. | |
| 4,686,719 A | | 8/1987 | Johnson et al. | |
| 4,837,872 A | | 6/1989 | DiMatteo et al. | |
| 4,860,395 A | | 8/1989 | Smith | |
| 4,944,060 A | | 7/1990 | Peery et al. | |
| 4,962,552 A | | 10/1990 | Hasty | |

(Continued)

OTHER PUBLICATIONS

Dionne, Michael, "Bariatric Ergonomics," Treating the Bariatric Patient, (Jan. 6, 2003), Gainesville, GA.

(Continued)

*Primary Examiner*—Michael Trettel
(74) *Attorney, Agent, or Firm*—David H. Jaffer; Pillsbury Winthrop Shaw Pittman LLP

(57) ABSTRACT

A disposable patient transfer mattress includes a rectangular top sheet, a rectangular bottom sheet, internal baffles, and a receptacle configured to receive a connector for supplying air to inflate the mattress. The bottom sheet corresponds to the top sheet, and the periphery of the bottom sheet is joined to the periphery of the top sheet. The internal baffles extend between the top sheet and the bottom sheet. Each baffle is a rectangular sheet with first and second parallel edges, and each baffle is joined to the top sheet along the first edge and to the bottom sheet along the second edge. The bottom sheet has a plurality of holes configured to provide a continuous cushion of air under the mattress when the mattress is inflated. The top sheet, bottom sheet, and internal baffles are made of fabric backed with a thermally weldable material, where the thermally weldable material faces the interior of the mattress for facilitating thermal welding of the baffles to the top surface and the bottom surface.

33 Claims, 7 Drawing Sheets

U.S. PATENT DOCUMENTS 5,044,030 A * 9/1991 Balaton ..... 5/710
5,048,134 A 9/1991 Dennill et al.
5,065,464 A 11/1991 Blanchard et al.
5,067,189 A 11/1991 Weedling et al.
5,090,077 A 2/1992 Caden et al.
5,235,713 A 8/1993 Guthrie et al.
5,487,196 A 1/1996 Wilkinson et al.
5,561,873 A 10/1996 Weedling
5,742,958 A 4/1998 Solazzo
5,788,291 A * 8/1998 Williams et al. ..... 285/325
5,860,174 A 1/1999 Failor
5,960,497 A 10/1999 Catellino et al.
5,996,150 A 12/1999 Blevins et al.
6,021,533 A 2/2000 Ellis et al.
6,073,284 A 6/2000 Borders
6,073,291 A 6/2000 Davis
6,295,675 B1 10/2001 Ellis et al.
6,427,270 B1 8/2002 Blevins et al.
6,467,106 B1 10/2002 Heimbrock
6,467,113 B2 10/2002 Ellis et al.
6,484,334 B1 11/2002 Borders et al.
6,775,868 B1 * 8/2004 Mileti et al. ..... 5/710
6,898,809 B2 * 5/2005 Davis ..... 5/81.1 R
6,922,863 B2 * 8/2005 Giori et al. ..... 5/709
7,114,204 B2 * 10/2006 Patrick ..... 5/81.1 R
7,314,238 B2 * 1/2008 Robert ..... 285/103
2002/0029423 A1 3/2002 Ellis et al.
2002/0166168 A1 11/2002 Weedling et al.
2003/0019042 A1 1/2003 Ellis et al.
2003/0070226 A1 4/2003 Heimbrock
2003/0159212 A1 8/2003 Patrick

OTHER PUBLICATIONS

Hovermatt, A D.T. Davis Enterprise, "Patient Handling Technologies, Specializing in Patient Handling & Workers Comp. Reduction Programs," (Oct. 1, 2000), Allentown, PA.
Hovermatt, "A Cushion of Air That Makes Transferring our Patients a Breeze." (Date Unknown).
Plexus Medical, "Low Air Loss/APM Therapy System Operating Instructions," (Feb. 2002).

* cited by examiner

Section x-x

DISPOSABLE PATIENT TRANSFER MATTRESS

RELATED APPLICATIONS

This application is a continuation-in-part of U.S. patent application Ser. No. 11/538,211 filed Oct. 3, 2006, which in turn is a continuation-in-part of U.S. patent application Ser. No. 11/036,413 filed Jan. 14, 2005, which issued as U.S. Pat. No. 7,114,204 on Oct. 3, 2006.

FIELD OF THE INVENTION

The present invention relates generally to an apparatus for transferring bed patients, and more particularly to a disposable inflatable mattress for moving a patient on a cushion of air, and to a system including an inflatable mattress connected to an air supply by a quick release connector.

BACKGROUND OF THE INVENTION

Non-ambulatory patients who must be supported and moved in a patient facility such as a hospital or a nursing home present substantial challenges when a course of treatment for such patients calls for movement from one location to another. A patient, for example, may need to be moved from a hospital bed, which must remain in the patient's room, to a stretcher and then from the stretcher to a treatment location such as a surgical table in an operating room. Following treatment the reverse patient handling sequence must occur; i.e., the patient must be moved from the surgical table, which remains in the operating room, to a stretcher which travels to the patient's hospital room, and then from the stretcher back onto the bed in the hospital room. In a very large percentage of such occurrences the patient must be handled in a fashion which requires only a minimum of movement of the patient with respect to a supporting surface. In the case of a patient being returned to a hospital room following surgery, for example, the patient's body may not be able to withstand the stresses and strains of being lifted from a stretcher to the bed when one or even several hospital personnel combine their efforts to make such a transfer.

The same challenge of moving a patient with minimum handling exists in non-surgical settings as well. The bariatric patient is a prime and very common example. When such a patient is morbidly obese, transferring presents difficulties for both the patient and the care facility staff. While no exact definition of morbid obesity is universally recognized, many hospitals and other treatment facilities consider a person who weighs about 350 pounds or more to fall within that definition. Movement of a morbidly obese person often requires the hospital staff to physically lift and/or slide the patient from an at rest position on a hospital bed to an at rest position on a stretcher a total of four times to complete a single treatment cycle, such as surgery. The staff must perform the task of lifting and/or sliding such a patient because in nearly all instances the patient, due to the physical condition of obesity and/or illness, simply cannot personally do the task. The manipulation of such a person requires a plurality of hospital staff since such manipulation is impossible to perform by a single person such as a floor nurse assigned to the patient's room. As a consequence, such transfers must be planned in advance for a specific time and a number of hospital staff must be notified and arrange their schedules so that all staff will be available at the same time. As is well known, many hospital staff are females and many of these persons are rather slight of stature. As a result, a half dozen or more such persons may need to be assembled. Instances have been known in which a morbidly obese patient has required twelve persons to effect the transfer. Gathering together such a large number of people four times at often uncertain intervals to provide but a single cycle of treatment raises obvious logistical problems and, in addition, erodes the quality of care the facility can render by reason of the application of such a large number of personnel to deal with but a single patient treatment episode. A further drawback to such a patient handling system, as described above, is that, even with the best intentioned and caring of staff, the patient very often suffers substantial discomfort. The simple act of sliding a patient over a flat surface can be very painful to a patient who has had surgical incisions which are far from healed, for example.

An attempt has been made to overcome the above described problems by the use of an air mattress onto which the patient is placed while in his bed and which is then placed onto a wheeler. A problem common to all such devices is that invariably the air mattress has the general characteristic of a balloon, in the sense that when one area is indented another remote area will bulge, thus creating an unstable condition. If for example a stretcher carrying an obese person makes a sharp turn during a trip to or from a treatment location, such an obese person will tend to roll toward the outside of the turn due to the instability of such a conventional mattress. The more the patient rolls, the more the mattress portion toward which the rolling movement occurs will depress, and the greater will be the expansion of the mattress on the other side of the patient. In effect, the conventional mattress reinforces the undesirable rolling movement and is unstable. Since much of the time the patient is incapable of stopping the rolling action by himself, the patient may roll off the stretcher onto the floor with disastrous consequences. Indeed, even in the instance of a patient who is capable of moving himself to some degree about his longitudinal body axis the same disastrous result may occur because the displacement of air from one edge portion of the mattress to the opposite edge portion creates in effect a tipping cradle. Only if the patient lies perfectly flat and perfectly still on the stretcher, and no roadway depressions or blocking objects, such as excess hospital beds stored in a hallway, are encountered can the probabilities of an accident be lessened.

Another problem with prior art methods of moving patients using an air cushion is the complexity of the procedure. The air mattress must first be positioned under the patient. Then an air pump must be transported to the bed area and connected to the mattress. The mattress is then inflated and the patient moved. The same process is repeated each time the patient needs to be transferred from one bed/stretcher/table to another.

A still further problem with prior art apparatus is control of contamination. Often, a tedious cleaning protocol follows after such use to avoid cross-contamination. Cleaning is particularly difficult because contaminant particles can penetrate into the mattress material, and when the mattress is inflated, contaminant particles may be expelled into the air. The high cost of many prior art air cushions requires their re-use.

Another problem with prior art systems is the process of forcing air out of the small holes in the bottom surface of the air mattress may result in an enlargement of the holes over time, rendering them less effective in levitating the mattress and its load. The consequence of poor levitation is an increase in resistance for lateral transfer and repositioning of the mattress and its load.

A still further problem with prior art systems is the difficulty of connecting and disconnecting an air supply from the air mattress. For example, some prior art air mattresses require inserting an air supply hose into a fabric sleeve in the air mattress in order to inflate the mattress. This requires finding the sleeve in the uninflated mattress, separating the fabric to open up the sleeve and then inserting the hose far enough into the sleeve for the connection to be effective. There is a need for a quicker and easier way of connecting an air hose to the mattress.

SUMMARY OF THE INVENTION

A disposable patient transfer mattress is described herein. The disposable mattress comprises: a rectangular top sheet; a rectangular bottom sheet; internal baffles; and a receptacle configured to receive a connector for supplying air to inflate the mattress. The bottom sheet corresponds to the top sheet, dud the periphery of the bottom sheet is joined to the periphery of the top sheet. The internal baffles extend between the top sheet and the bottom sheet. Each baffle is a rectangular sheet with first and second parallel edges, and each baffle is joined to the top sheet along the first edge and to the bottom sheet along the second edge. The baffles are configured to divide the internal volume of the mattress into a plurality of connected chambers and impart structural integrity and rigidity to the mattress. The bottom sheet has a plurality of holes configured to provide a continuous cushion of air under the mattress when the mattress is inflated. The receptacle is integrated into the top sheet. The top sheet, bottom sheet, and internal baffles are made of fabric backed with a thermally weldable material, where the thermally weldable material faces the interior of the mattress for facilitating thermal welding of the baffles to the top surface and the bottom surface. The thermal welding process is preferably ultrasonic welding. An example of the fabric and backing is 70 dernier nylon fabric backed with polyvinylchloride (PVC), where the nylon fabric provides strength and the PVC allows for air tight joining by thermal welding. The receptacle may be made of rubberized nylon and can be thermally welded to the top sheet. Due to the low cost of materials and manufacturing, the air mattress of the invention is viable as a single use—disposable—air mattress.

Some embodiments of the disposable air mattress described herein are made of biodegradable materials. For example, the thermally weldable material used in the top and bottom sheets and the baffles may be made of aliphatic aromatic copolyesters.

A patient transfer system is described herein. The system comprises: an inflatable mattress having a bottom surface with a plurality of holes configured to provide a continuous cushion of air under the mattress when the mattress is inflated; a receptacle integrated into the mattress; an air supply cart for inflating the mattress; and a connector attached to the air supply cart by a flexible hose, where the connector and receptacle are configured for ease of connecting and disconnecting the air supply from the air mattress. The receptacle is made of a rubber-like material, and comprises: a disc with a centrally positioned opening through which air can be pumped into the mattress; a U-shaped groove on the upper surface of the disc, centered on the opening; and a slot positioned on the perimeter of the disc at the center of the open part of the U in the U-shaped groove. The connector is made of a rigid material, and comprises: a tube; a rim at one end of the tube, where the rim extends radially out from the end of the tube; and a key on the periphery of the rim. The connector is mated to the receptacle by sliding the rim into the groove until the key is in the slot. The key and the slot are configured so that when the key is in the slot the upper surface of the receptacle and the rim of the connector are kept in contact while air is pumped into the mattress.

DETAILED DESCRIPTION

Figure 1:
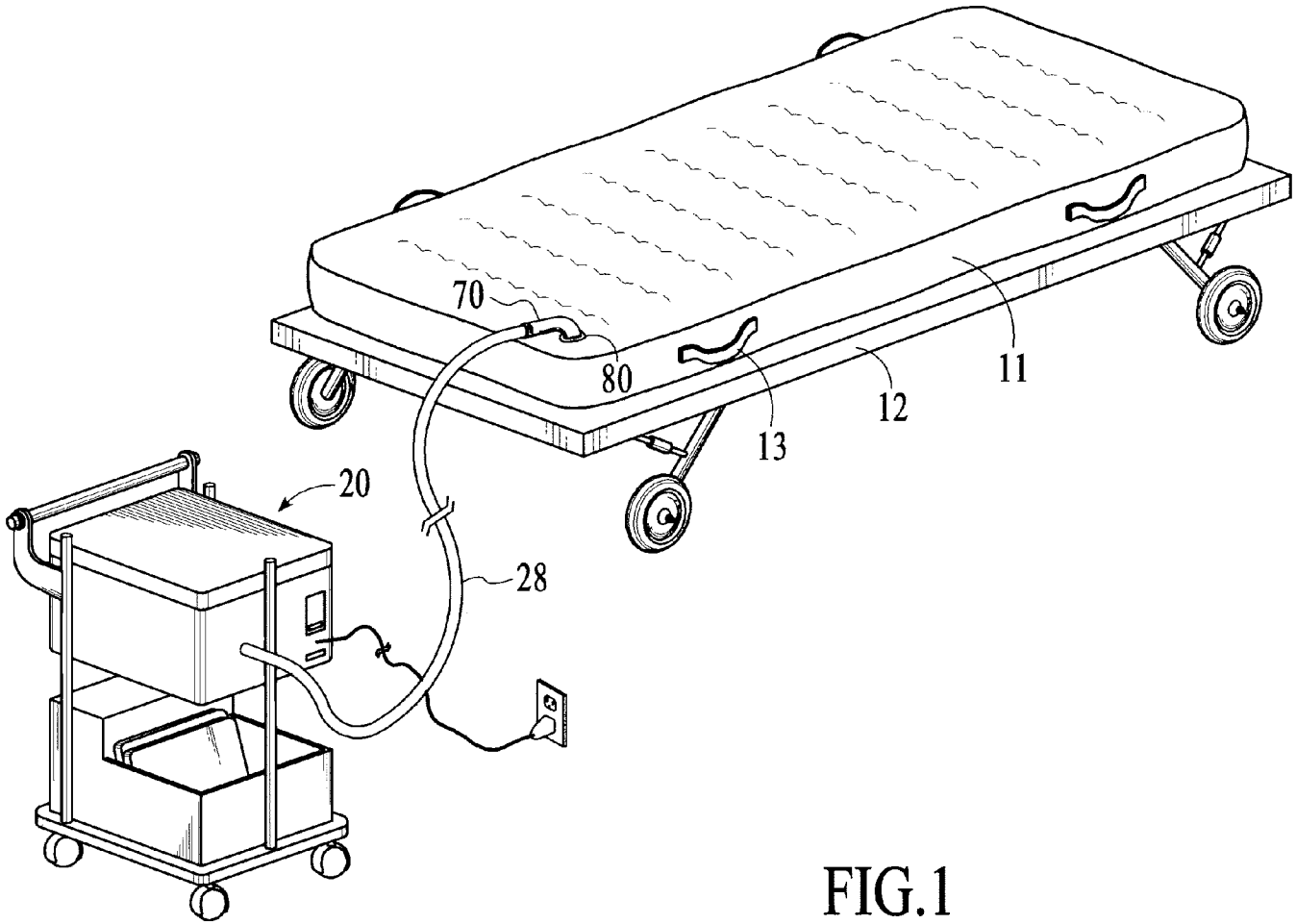
FIG. 1 illustrates a patient transfer system according to the present invention as applied to a stretcher.

An embodiment of the present invention is illustrated generally in FIG. 1 as applied to a planar item 12, which in this case is represented as a stretcher. In this embodiment, a portable air supply cart 20 is provided for supplying air to an air mattress 11. The portable air supply cart 20 is connected to the air mattress 11 by means of a flexible hose 28 with a connector 70 which is received by a receptacle 80 integrated into the air mattress 11. The term "air" as used in the present disclosure refers to air or any other gas that can be used to inflate an inflatable mattress. "Air mattress" therefore refers to a mattress that can be inflated with any such gas. The planar item 12 can be any type of bed/surface for supporting a patient, such as a stretcher or hospital bed, and will be referred to herein as a bed apparatus. The inflatable air mattress 11 can be positioned on a firm surface such as planar item 12 illustrated in FIG. 1, or alternatively the air mattress 11 can be placed either on top of or under a non-inflatable mattress. These alternative configurations are shown and discussed in reference to FIG. 3. The air mattress is moved using handles 13. The receptacle 80 is shown in FIG. 1 as being positioned in the top surface of the mattress 11; this position is preferred, although the receptacle may be positioned elsewhere.

Figure 2:
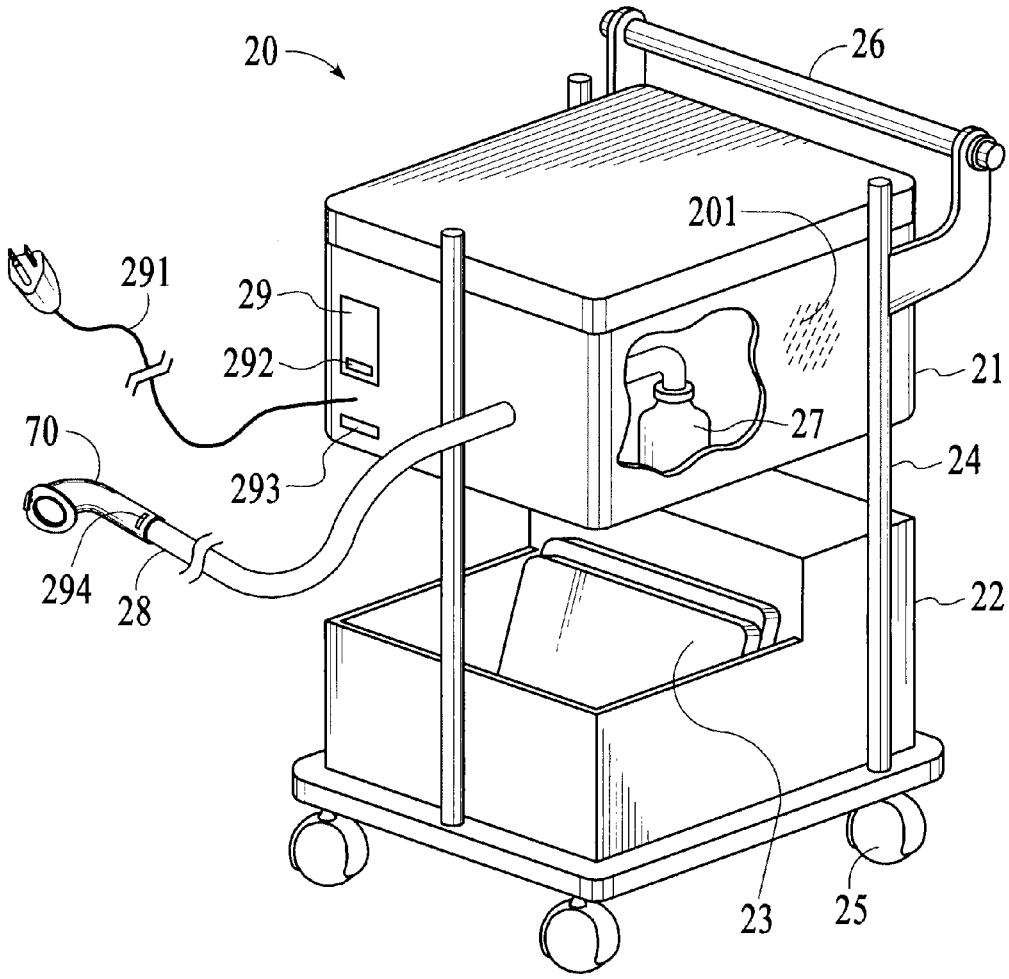
FIG. 2 illustrates an air supply cart according to the present invention.

As illustrated in FIG. 2, the portable air supply cart 20 includes air supply system 21, compartment 22 for storage of one or more uninflated, hermetically packaged, air mattresses 23, and a structural frame 24 to which wheels 25 and a handle 26 are attached. The frame 24 supports the air supply system 21 and the compartment 22, and the handle 26 allows a user to conveniently maneuver the cart. The air supply system 21 includes a gas/air blower 27 (the housing of the air supply system has been cut-away to show the blower), a gas/air hose 28 attached to the blower at one end, a power supply 29 including a rechargeable battery, and a power cord 291. The cord 291 can be plugged into an AC outlet for running the blower, and/or for charging the battery. The blower can be operated from the battery without the need to plug the cord into an outlet, providing the battery is sufficiently charged. The supply 29 also includes an on-off switch 292, and, in some embodiments, a display/indicator 293 for showing the degree of charge stored in the battery. The hose 28 has a connector 70 on a distal end for connection to a receptacle 80 on the air mattress 11. In some embodiments, an auxiliary power switch 294 is integrated into the connector 70. The power switch 294 may be a rocker-type on-off switch, or a membrane switch. When the switch 294 is positioned in the connector 70, an electrical cable (not shown) runs along the hose 28, making electrical connection between the switch 294 and the supply 29. In some embodiments, various portions of the cart 20 may be coated in part, or completely, with an antimicrobial coating, indicated symbolically with dots on a portion 201.

Figure 3:
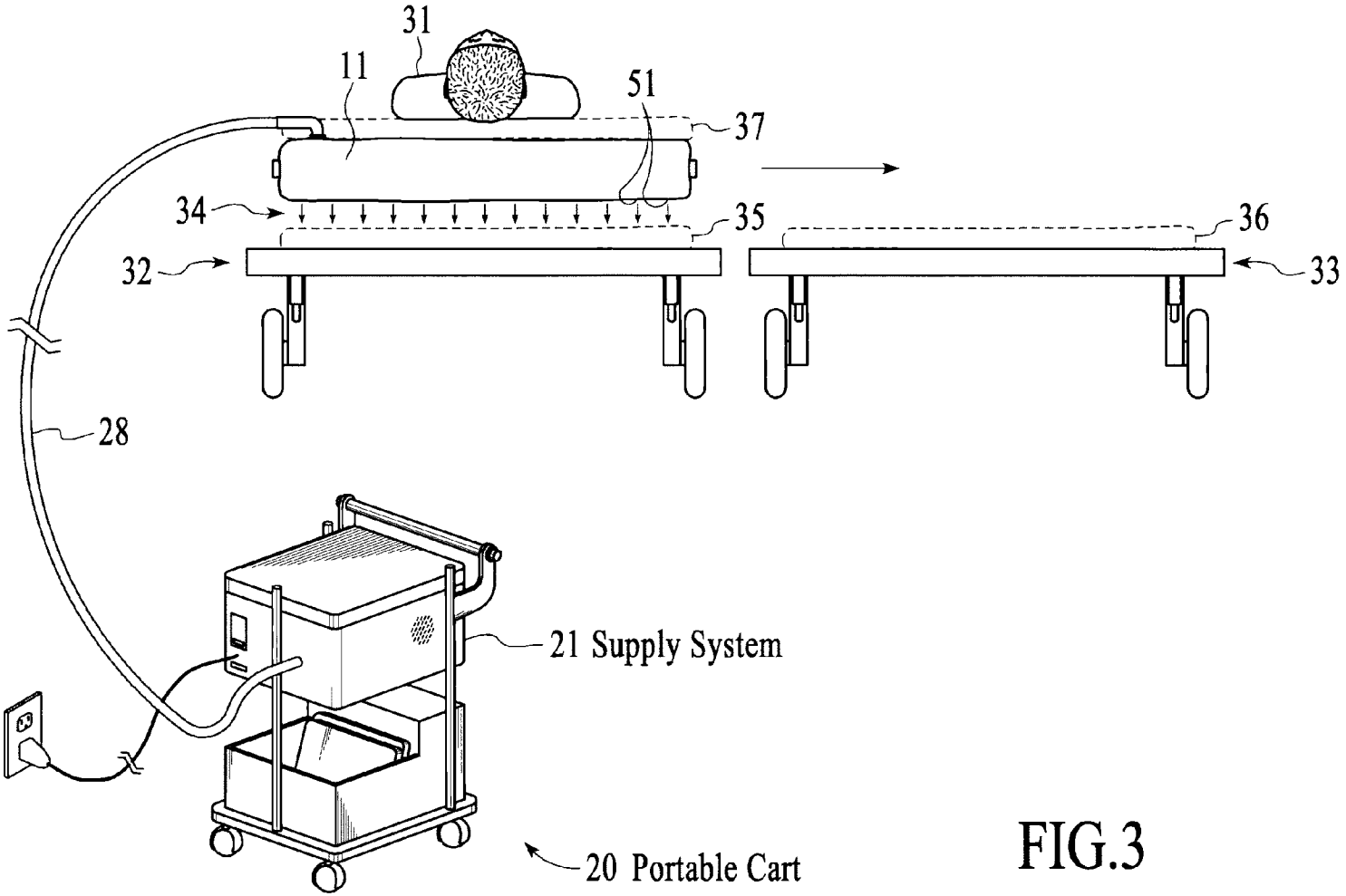
FIG. 3 illustrates patient movement between beds using the patient transfer system according to the present invention.

FIG. 3 illustrates a system of the present invention in operation. A patient 31 is on a first bed apparatus 32, and is to be moved onto an adjacent second bed apparatus 33. The patient 31 has been placed on an inflatable mattress 11 for providing an air cushion 34. The supply system 21 has a flexible hose 28 connected to the air mattress 11 and is supplying a gas, a portion of which is forced out of exit holes 51, causing the air mattress 11 to float on a cushion of air/gas 34. The cushion of air/gas 34 must be continuous under the mattress 11. An attendant can at this stage, move the patient on said air mattress 11 over onto the bed 33. FIG. 3 also illustrates placing the air mattress either above or below a non-inflatable mattress. Dashed outline 35 illustrates a non-inflatable mattress on which air mattress 11 is placed. A similar non-inflatable mattress 36 can also be placed on bed 33. Alternatively, the air mattress 11 can be placed under a non-inflatable mattress 37 upon which the patient 31 is placed. Any combination of inflatable air mattresses as described herein with non-inflatable mattresses on any of the various beds described in the present disclosure are included in the present invention.

Figure 4:
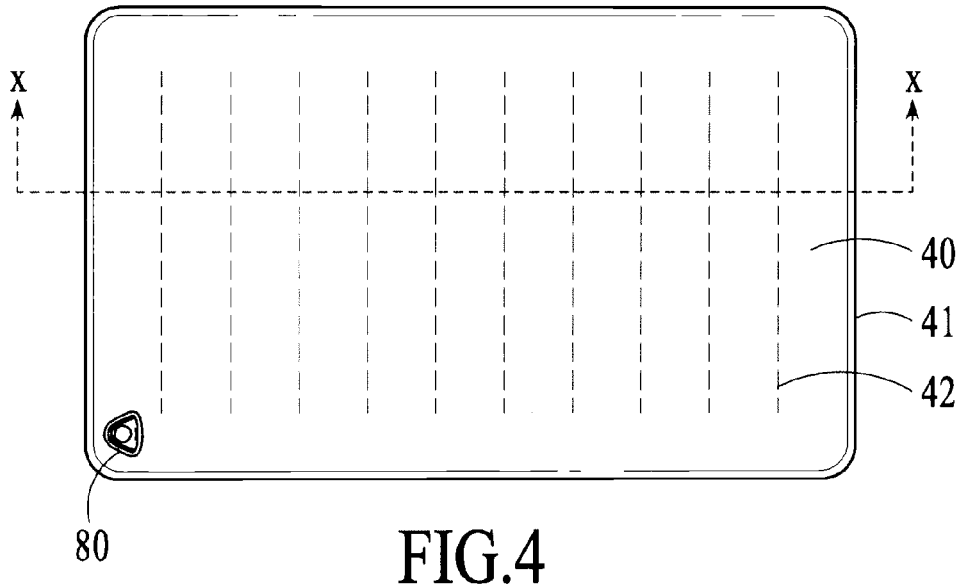
FIG. 4 illustrates a top view of an air mattress according to the present invention.
Figure 5:
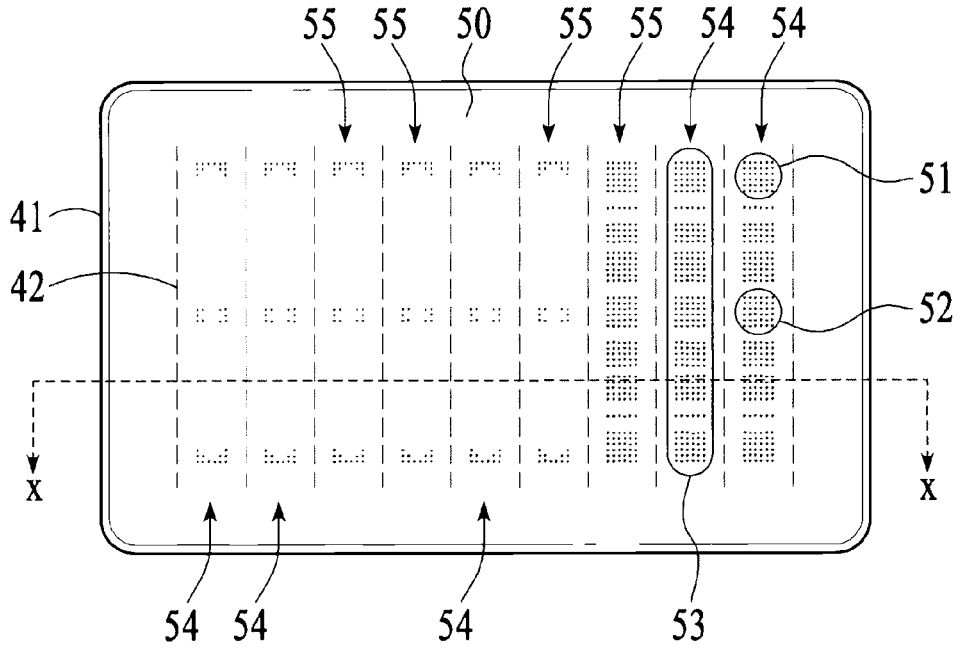
FIG. 5 illustrates a bottom view of the air mattress of FIG. 4.

The air mattress 11 is comprised of corresponding continuous rectangular top and bottom sheets, joined at their edges. The air mattress 11 is made in a variety of sizes, to suit the needs of hospitals, care providers, etc. Some examples of typical air mattress dimensions (when properly inflated) are: 203 cm long×89 cm wide×19 cm deep; 203 cm long×99 cm wide×19 cm deep; 203 cm long×122 cm wide×19 cm deep. FIGS. 4 and 5 show the top and bottom views, respectively, of the air mattress 11. The air mattress' top sheet 40 is shown in FIG. 4. A receptacle 80 is shown integrated into the top sheet 40, for connecting to an air supply such as portable air supply 20. (See FIG. 2.) Welding seams 41 and 42 are shown on the top sheet 40. These particular seams are created when (1) internal baffles 60 (see FIG. 6) are welded in place (seams 42) and (2) the top and bottom sheets of the mattress are welded together at the perimeter (seam 41). The welding process is a thermal welding process which relies on heating the material sufficiently to form an air tight joint. For ease of manufacture, the thermal welding process is preferably an ultrasonic welding process. The baffles 60 have the effect of controlling the flow of air through the mattress and help to maintain the functionality of the mattress, as a levitating device, when loaded with a heavy body. Here the baffles 60 are shown as being equally spaced and indicated as running straight across the air mattress (parallel to the short sides of the rectangular mattress), but the baffles may also be serpentine, run along the length of the mattress (i.e. perpendicular to the direction shown in FIGS. 4 and 5), or have some other efficacious configuration. (The baffles are discussed in more detail below and are shown in cross-section in FIG. 6.) Having welded, rather than stitched, seams, where the baffles 60 are joined to the top and bottom sheets of the mattress, helps to reduce artifacts in x-ray images. Consequently, diagnostically usefully x-ray and images of patients taken while the patient is on an air mattress of the invention can be acquired, even when the imaging must be done through the air mattress. Furthermore, since the mattress 11 comprises no metals, a patient can be lying on a mattress of the invention during magnetic resonance imaging (MRI).

In FIG. 5, the air mattress' bottom sheet 50 is shown. Welding seams 41 and 42 are shown on the bottom sheet 50. These seams are due to (1) welding the internal baffles to the bottom sheet (seams 42) and (2) sealing of the top and bottom sheets around the perimeter (seams 41). These seams correspond to the seams on the top sheet 40, as shown in FIG. 4. The holes for exit of gas/air, are indicated as items 51. For convenience of illustration, not all of the holes 51 are shown. The air mattress 11 is constructed with small holes in the bottom sheet 50 to allow gas to exit from inside the mattress 11 so as to create an air cushion for levitating the air mattress. (See FIG. 3 for an illustration of levitation.)

Figure 6:
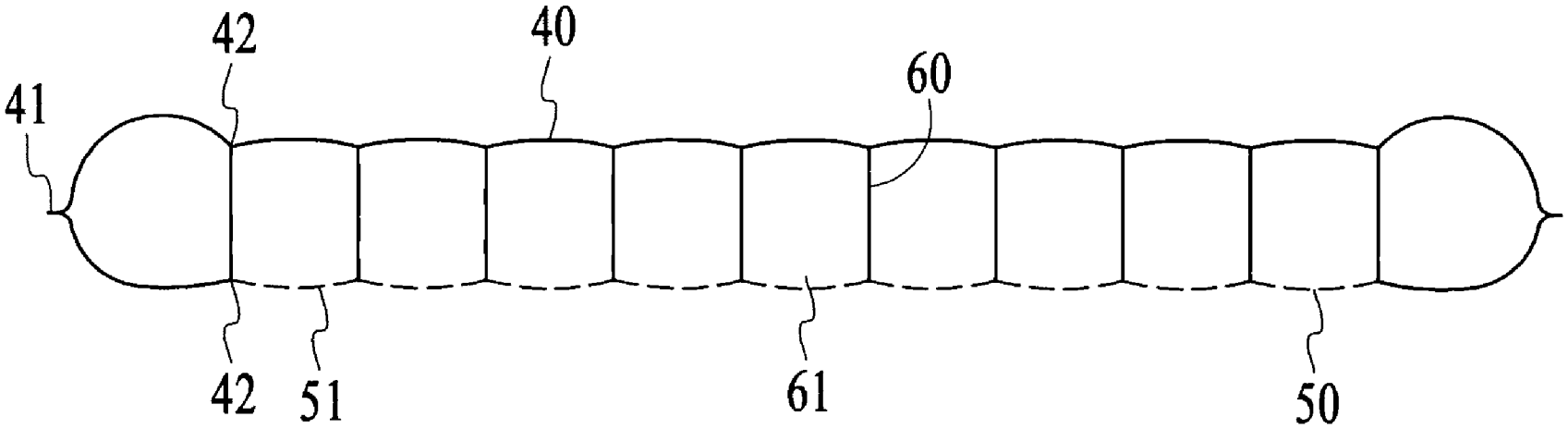
FIG. 6 is a cross-sectional view of the air mattress of FIGS. 4 and 5.

In FIG. 6, the mattress 11 is shown in cross-section to illustrate the configuration of internal baffles 60. The baffles 60 divide the interior volume of the mattress 11 into a plurality of connected chambers 61. These chambers 61 allow for air flow within the mattress. The baffles 60 are configured to provide stability and to help ensure uniform levitation of the mattress. In the particular embodiment shown, there are 10 baffles spaced approximately 180 mm apart. The holes 51 in bottom sheet 50 for exit of gas/air are, for purposes of illustration, shown at a lower density than in the actual mattress. The baffles 60 are rectangular sheets. Each baffle is joined to the top sheet 40 along a first long edge and to the bottom sheet along the second long edge (parallel to the first edge when the mattress is fully inflated). The baffles 60 are attached to the top sheet and bottom sheet using a low-cost thermal welding technique, preferably sonic welding.

Referring to both FIGS. 5 and 6, the holes 51 are 0.8 mm in diameter and are arranged in groups 52, ranging in size from 5 to 60 holes. The groups 52 are arranged in bands 53 lying between the baffles 60. The groups are spaced approximately 40 mm apart and the holes are spaced approximately 15 mm apart within each group. In the embodiment of the invention shown in FIG. 5, there are bands with two different arrangements of holes—bands 54 and bands 55. In bands 54 the holes are arranged into groups as follows, where the groups are listed from top to bottom and are given as no. holes in column x no. holes in row: 6×5, 1×5, 10×5, 5×5, 10×5, 1×5 and 6×5. In bands 55 the holes are arranged into groups as follows, where the groups are listed from top to bottom and are given as no. holes in column x no. holes in row: 6×6, 1×6, 10×6, 5×6, 10×6, 1×6 and 6×6. The groups of holes are arranged so that the highest density of holes is in the generally central area of the mattress so as to accommodate the typical weight distribution of a patient lying on the mattress. (The heaviest parts of a patient are typically positioned over central regions of the mattress.) Furthermore, there are no holes around the periphery. In a typical embodiment there are no holes in the bottom sheet within 11 cm of the long edges of the mattress and within 27 cm of the short edges of the mattress. (Where the mattress is rectangular and the short edges correspond to the edges close to where the head and feet of the patient are positioned.) When air is forced into the mattress this results in there being a slightly higher pressure within the mattress around the periphery where there are no holes. The higher pressure around the periphery results in the mattress inflating a little more around the periphery, thus cradling the patient on the mattress and preventing the patient from rolling off the mattress. To further enhance the cradling effect, the baffles 60 do not extend to the edges of the mattress 11. In typical embodiments the baffles extend only to approximately 9 cm from the edge of the mattress 11. (See FIGS. 4 and 5.) Considering the area over which the holes are distributed, the density of holes and the diameter of the holes, the portable air supply cart need only provide gas under a pressure of approximately 1 pound per square inch in order to levitate a patient with a weight in excess of 300 pounds. The groups of holes may be varied in there position, the number of holes in a group may be varied, and the size of the holes may be varied, providing: (1) the overall distribution of holes is effective in accommodating the weight distribution of the patient lying on the mattress; (2) there is sufficient air pressure to levitate the patient; and (3) the holes are sufficiently well distributed so as to ensure the mattress is levitated over the entire bottom surface.

Referring again to FIGS. 4 and 5, the mattress' top sheet 40 is preferably a very light color, even white, for easy observation of contamination by operating personnel. The bottom sheet 50 may be marked to indicate that it must be placed facing downward. For example, the bottom sheet may be colored dark blue and the top sheet may be white, in which case the bottom surface is readily identifiable.

A substantial portion of the air mattress 11 is preferably constructed of polyvinylchloride (PVC), nylon, polyester and other inexpensive polymer materials. Typical embodiments have top and bottom sheets and internal baffles made of nylon fabric backed with PVC, where the nylon fabric is preferably 70 denier. The 70 denier nylon backed with PVC is approx. 0.2 mm thick, with the PVC surface facing the inside of the mattress. It is the PVC material surfaces that are welded together to form the welding seams 41 and 42. Other materials may be used for the top and bottom sheets and the baffles. For example, materials that have the following characteristics: (1) low cost; (2) form air tight seals using low cost thermal welding techniques; and (3) sufficient strength to accommodate the forces applied to the mattress during use. Furthermore, other suitable materials for the top and bottom sheets may be combinations of materials, where a first material is used for its strength, a second material is used for its ability to form air tight joins using a thermal welding technique, and the two materials are bonded together to form the sheet.

Polyester webbing may be used to reinforce the welding seam 41 around the periphery of the mattress. (See FIGS. 4-6.) The polyester webbing wraps over the edge of the mattress and is stitched to the peripheral welding seam 41. The handles 13 are made of polyester webbing and are attached to the edge of the mattress by stitching. (See FIG. 1.) Other materials may be used to reinforce the edges and make the handles—for example, strong fabrics and synthetic woven materials that can readily be stitched to the edge of the mattress.

Due to the low cost of materials and manufacturing, the air mattress of the invention is viable as a single use—disposable—air mattress. The low cost, disposable air mattress of the present invention is a major improvement in sanitation for an inflatable air mattress, since contaminant particles can become embedded in the air mattress material which makes cleaning difficult. This is a particular problem for inflatable air mattresses because when an air mattress is inflated the gas pressure forces contaminants from the material, making them air borne. Furthermore, for a single-use, disposable, mattress cleaning is not a concern. Consequently, the mattress of the invention may take advantage of inexpensive materials for which a cleaning protocol does not exist, such as PVC.

In yet further embodiments of the disposable mattress of the invention, biodegradable materials are used for the upper and lower sheets and the baffles. For example, a biodegradable material can be used which comprises aliphatic aromatic copolyesters (available from BASF under the tradename Ecoflex®.) Such materials are suitable for thermal welding. However, in order to achieve the strength required for the mattress fabric, aliphatic aromatic copolyesters should be bonded to a biodegradable fabric with the requisite strength.

Referring to FIG. 6, the process of forcing air out of the small holes 51 in the bottom sheet 50 of the air mattress 11 results in an enlargement of the holes over time, rendering them less effective in levitating the mattress and its load. The consequence of poor levitation is an increase in resistance for lateral transfer and repositioning of the mattress and its load. However, a disposable mattress has the advantage that it can easily be engineered to operate effectively without such concerns. This is because the total time for which a single use mattress will be used can be fairly accurately estimated and then the mattress can be designed to operate effectively over the calculated time period. In contrast, the total time for which a non-disposable mattress will be used is much more difficult to correctly estimate, thus presenting a more demanding design problem.

Figure 7:
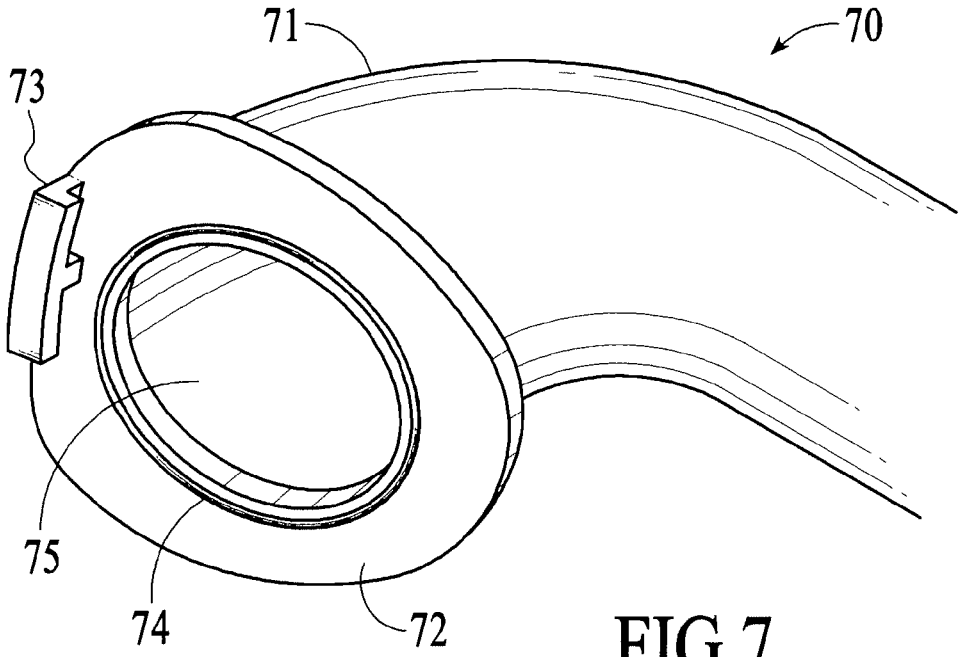
FIG. 7 illustrates a connector for attaching an air supply hose to the mattress.
Figure 8:
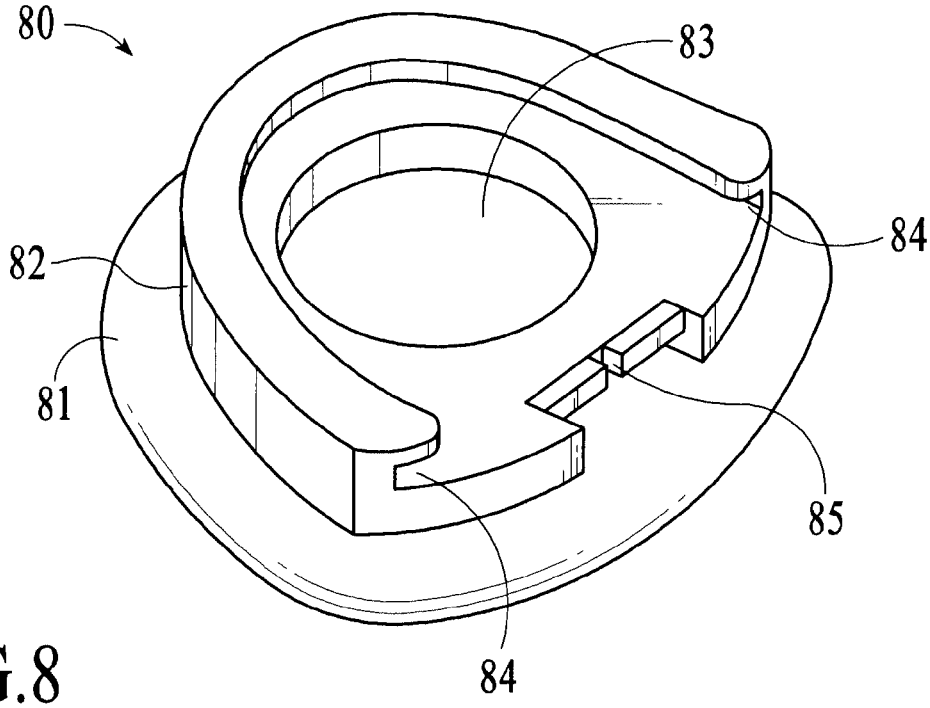
FIG. 8 illustrates a receptacle on the mattress for receiving the connector of FIG. 7.

FIGS. 7 and 8 provide a more detailed view of the receptacle 80 and connector 70. The connector 70 is a generally cylindrical tube 71 at the end of which is a rim 72 extending radially outwards. There is a key 73 attached to the edge of the rim and an annular protrusion 74 on the bottom surface of the rim 72. Air is delivered from the air supply module 21, through flexible hose 28 and out of aperture 75 at the end of tube 71. The receptacle 80 is a disc 82 with a central opening 83, through which air passes into the mattress 11. A flange 81 extends radially outwards from the disc 82, providing a surface for joining the receptacle 80 to the top sheet 40 of the mattress 11. The receptacle 80 has a U-shaped groove 84 on the upper surface of the disc 82 which is centered on the central opening 83. The groove 84 mates with the flat rim 72 of connector 70—the rim 72 easily slides in to the groove 84. The groove 84 has a depth of 166 thousandths of an inch where the connector is first inserted at the open end of the U of the U-shaped groove, narrowing to 120 thousandths of an inch at the bottom of the U of the U-shaped groove. The narrowing of the groove is designed to allow easy insertion of the connector 70 into the receptacle 80, and yet provide a sufficiently snug fit to allow for an air-tight seal. The seal is enhanced by an annular protrusion 74 on the surface of the rim 72 of connector 70. Considering that connector 70 is made of a rigid material and that receptacle 80 is made of a rubber-like material, the protrusion pushes into the readily deformable top surface of disc 82 to form an air-tight seal. (Discussion of preferred materials for the connector and receptacle is found below.) Furthermore, where the groove 84 is not present to keep the receptacle and connector surfaces in close contact (the part of the disc 82 at the open part of the U of the U-shaped groove 84), the key 73 fits into slot 85 and stops the flexible disc 82 from distorting. This is important during operation of the air mattress so as to avoid an air leak if the flexible disc 82 were to distort and no longer be in close contact with rim 72 of the connector 70. To ensure the key 73 lines up with the slot 85 so as to be able to properly engage, the rim 72 is wider where the key 73 is positioned and the width of the U of the U-shaped groove 84 uniformly narrows from the open end of the U to the bottom of the U.

Figure 9:
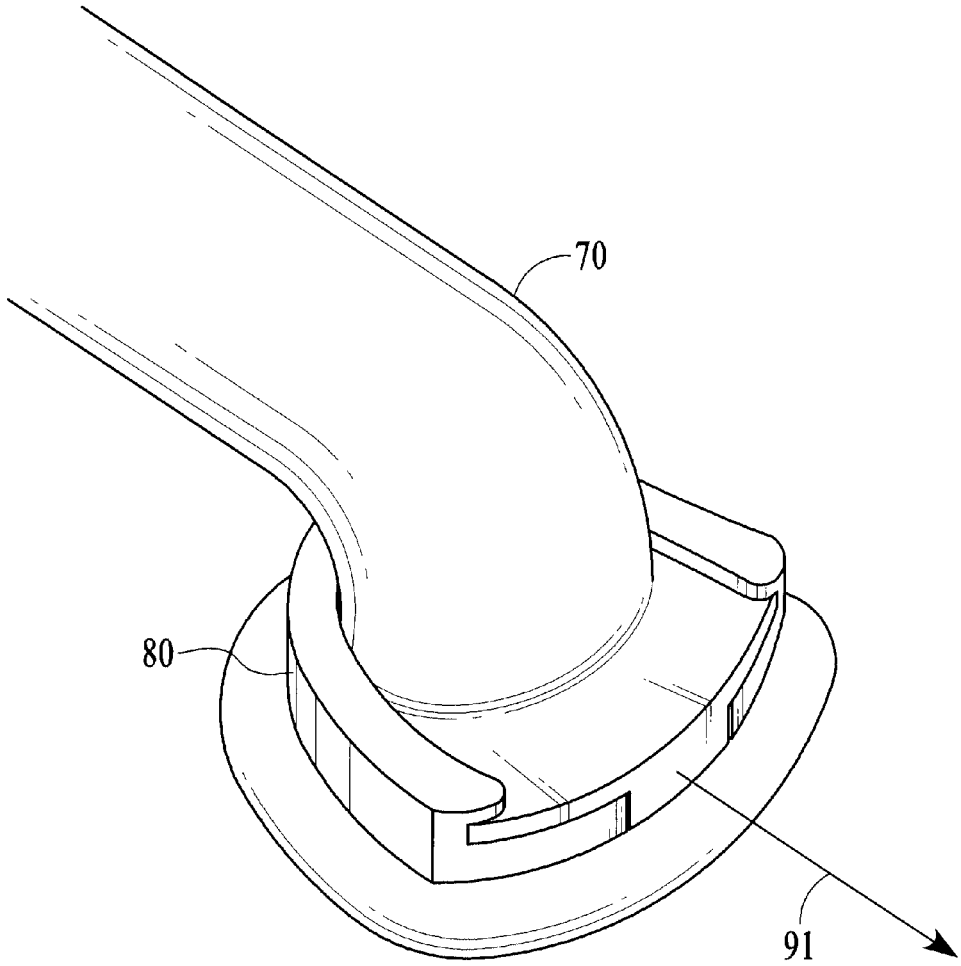
FIG. 9 illustrates the connector of FIG. 7 mated with the receptacle of FIG. 8.

The mated receptacle 80 and connector 70 are shown in FIG. 9. To disengage the connector from the receptacle the connector is moved in direction 91—sliding rim 72 out of groove 84 and disengaging key 73 from slot 85. The reverse procedure is used to mate the connector 70 to the receptacle 80—rim 72 is slid into groove 84 until key 73 engages in slot 85.

As seen in FIG. 2, the connector 70 may also have a power switch 294 integrated into tube 71. The switch operates the air blower 27. The switch is positioned on the connector for operator convenience.

The connector 70 is made of a rigid, shatter-proof material with a nonporous surface, such as acrylonitrile butadiene styrene (ABS). Other suitable materials may include polycarbonates, such as Lexan® polycarbonates available from GE. The non-porous surface allows for easy cleaning of the attachment in order to maintain the sanitary conditions required in a hospital environment. The receptacle 80 is made of rubberized nylon. The flange 81 of the receptacle 80 is thermally welded to the PVC layer of the top sheet 40 of the mattress 11. The welding process is preferably an ultrasonic welding process. Other materials may be used for the receptacle. For example, materials that have the following characteristics: (1) low cost; (2) soft, flexible and strong; (3) moldable; (4) thermally weldable to the fabric of the top sheet of the mattress.

The above embodiments of the present invention have been given as examples, illustrative of the principles of the present invention. Variations of the apparatus and method will be apparent to those skilled in the art upon reading the present disclosure. These variations are to be included in the spirit of the present invention.

What is claimed is:

1. A patient transfer mattress, comprising:

a rectangular top sheet;

a rectangular bottom sheet corresponding to said top sheet, the periphery of said bottom sheet being joined to the periphery of said top sheet, said bottom sheet having a plurality of holes configured to provide a continuous cushion of air under said mattress when said mattress is inflated;

a plurality of internal baffles extending between said top sheet and said bottom sheet, each baffle being a rectangular sheet having first and second parallel edges, each baffle being joined to said top sheet along said first edge and to said bottom sheet along said second edge, said baffles being configured to divide the internal volume of said mattress into a plurality of connected chambers;

a receptacle integrated into said top sheet, said receptacle configured to receive a connector for supplying air to inflate said mattress; and a strip of reinforcing material attached to both said top sheet and said bottom sheet at the periphery of said mattress where said top sheet and said bottom sheet are joined, said reinforcing material being continuous over the edge where said top sheet and said bottom sheet are joined;

wherein said top sheet, said bottom sheet, and said baffles are comprised of fabric backed with a thermally weldable material, said thermally weldable material facing the interior of said mattress for facilitating thermal welding of said baffles to said top sheet and said bottom sheet.

2. A mattress as in claim 1, wherein said thermally weldable material is an ultrasonically weldable material.

3. A mattress as in claim 1, wherein said top sheet and said bottom sheet are joined by an air-tight thermal weld.

4. A mattress as in claim 1, wherein said receptacle is integrated into said top sheet by thermally welding said receptacle to said top sheet.

5. A mattress as in claim 1, wherein said fabric is a nylon fabric.

6. A mattress as in claim 5, wherein said nylon fabric is 70 denier, for providing strength to said mattress.

7. A mattress as in claim 1, wherein said receptacle is comprised of rubberized nylon.

8. A mattress as in claim 1, wherein there is a higher density of holes in the central region of said bottom sheet of said mattress for providing greater lift where the heaviest parts of a patient will typically be positioned on said mattress.

9. A mattress as in claim 1, wherein there are no holes in the peripheral region of said bottom sheet, for causing the peripheral region of said mattress to inflate more than the central region so as to cradle a patient lying on the top surface of said mattress.

10. A mattress as in claim 9, wherein said peripheral region extends at least 11 cm from the edge of said bottom sheet.

11. A mattress as in claim 1, wherein said mattress has a long side and a short side and said baffles are positioned parallel to said short side and spaced at equal intervals along said long side.

12. A mattress as in claim 11, wherein said baffles do not extend to the edges of said mattress, for facilitating greater inflation of said peripheral areas of said mattress compared to said central region, for cradling said patient lying on the top surface of said mattress.

13. A mattress as in claim 12, wherein said baffles extend to 9 cm from the periphery of said mattress.

14. A mattress as in claim 1, wherein said reinforcing material is polyester webbing.

15. A mattress as in claim 1, wherein said reinforcing material is stitched to said mattress.

16. A mattress as in claim 1, further comprising handles attached to said mattress at the periphery where said top sheet and said bottom sheet are joined, for facilitating moving said mattress.

17. A mattress as in claim 16, wherein said handles are comprised of polyester webbing.

18. A mattress as in claim 16, wherein said handles are stitched to said mattress.

19. A mattress as in claim 1, wherein said thermally weldable material is polyvinylchloride.

20. A mattress as in claim 1, wherein said thermally weldable material is biodegradable.

21. A mattress as in claim 20, wherein said biodegradable material comprises aliphatic aromatic copolyesters.

22. A patient transfer system comprising:

an inflatable mattress having a bottom surface with a plurality of holes configured to provide a continuous cushion of air under said mattress when said mattress is inflated;

a receptacle integrated into said mattress, said receptacle being formed of a rubber-like material, said receptacle comprising:

a disc with an opening through which air can be pumped into said mattress, said opening being positioned centrally in said disc; and wherein the upper surface of said disc has a U-shaped groove, centered on said opening; and wherein said disc has a slot positioned on the perimeter of said disc, said slot being further positioned at the center of the open part of the U in said U-shaped groove;

an air supply cart for inflating said mattress; and a connector attached to said air supply cart by a flexible hose, said connector being formed of a rigid material, said connector comprising:

a tube through which air is delivered to said mattress, said tube being roughly cylindrical in shape, connected to said hose at a first end and open at a second end;

a rim at the second end of said tube, said rim extending radially out from the second end of said tube; and a key on the periphery of said rim;

wherein said connector can be mated to said receptacle by sliding said rim into said groove until said key is in said slot, said key and said slot being configured so that when said key is in said slot the upper surface of said receptacle and said rim of said connector are kept in contact while air is pumped into said mattress.

23. A patient transfer system as in claim 22, wherein said receptacle is comprised of rubberized nylon.

24. A patient transfer system as in claim 22, wherein said connector is comprised of a nonporous material, to facilitate maintenance of sterile conditions.

25. A patient transfer system as in claim 22, wherein said connector is comprised of acrylonitrile butadiene styrene.

26. A patient transfer system as in claim 22, wherein the depth of said U-shaped groove is tapered, said groove being deeper at the open end of the U of said U-shaped groove.

27. A patient transfer system as in claim 22, wherein the width of the U of said U-shaped groove uniformly narrows from the open end of the U to the bottom of the U.

28. A patient transfer system as in claim 27, wherein said rim is wider where said key is positioned, whereby said rim fits snuggly into said groove.

29. A patient transfer system as in claim 22, wherein said rim has an annular protrusion configured to provide an air tight seal between said rim and said upper surface of said receptacle when said connector is mated with said receptacle.

30. A patient transfer system as in claim 22, wherein said receptacle further comprises a flange extending radially out from said disc, said flange providing a surface for joining said receptacle to said mattress.

31. A patient transfer system as in claim 30, wherein said receptacle is thermally welded to said mattress.

32. A patient transfer system as in claim 31, wherein said receptacle is ultrasonically welded to said mattress.

33. A patient transfer system as in claim 22, wherein said connector further comprises a power switch, for activating and deactivating an air blower in said air supply cart.

* * * * *